US006705790B2

(12) United States Patent
Quintero et al.

(10) Patent No.: US 6,705,790 B2
(45) Date of Patent: Mar. 16, 2004

(54) ADHESIVE APPLICATORS WITH IMPROVED APPLICATOR TIPS

(75) Inventors: Julian A. Quintero, Raleigh, NC (US); Keith R. D'Alessio, Cary, NC (US); Daniel L. Hedgpeth, Raleigh, NC (US); Roy Thompson, Raleigh, NC (US)

(73) Assignee: Closure Medical Corporation, Raleigh, NC (US)

( * ) Notice: Subject to any disclaimer, the term of this patent is extended or adjusted under 35 U.S.C. 154(b) by 0 days.

(21) Appl. No.: 10/134,603

(22) Filed: Apr. 30, 2002

(65) Prior Publication Data

US 2002/0176732 A1 Nov. 28, 2002

Related U.S. Application Data

(63) Continuation-in-part of application No. 09/479,060, filed on Jan. 7, 2000, now Pat. No. 6,425,704.

(51) Int. Cl.[7] ..... B43M 11/00

(52) U.S. Cl. ..... 401/132; 401/134; 401/196; 401/202

(58) Field of Search ..... 401/132, 133, 401/134, 135, 146, 202, 205, 263, 265; 222/81, 89, 90, 91, 190

(56) References Cited

U.S. PATENT DOCUMENTS

| | | | |
|---|---|---|---|
| 2,119,646 | A | 6/1938 | Pidel |
| 2,168,179 | A | 8/1939 | Tobey |
| 2,439,081 | A | 4/1948 | Dickey et al. |
| 2,768,109 | A | 10/1956 | Coover, Jr. |
| 2,784,127 | A | 3/1957 | Joyner et al. |

(List continued on next page.)

FOREIGN PATENT DOCUMENTS

| | | | |
|---|---|---|---|
| CH | 230000 | | 11/1943 |
| DE | 83 14 702 | | 9/1983 |
| EP | 0 170 526 | A2 | 2/1986 |
| EP | 0 320 131 | A | 6/1989 |
| EP | 0 463 658 | A1 | 1/1992 |
| EP | 0 495 357 | A1 | 7/1992 |
| FR | 713176 | | 10/1931 |
| GB | 553068 | | 5/1943 |
| GB | 2 083 742 | A | 3/1982 |
| JP | U-2-135479 | | 11/1990 |
| WO | WO 91/09641 | | 7/1991 |
| WO | WO 00/12411 | | 3/2000 |

OTHER PUBLICATIONS

Loctite Product No. 11067–2 (Rearview Mirror Adhesive); Jan. 1999.

Permatex Product No. ATA–1 (Auto Trim Adhesive); Jan. 1999.

Instruction Sheet for Immuno AG product TISSEEL KIT VH, Feb. 1993.

Product Literature for MedLogic product LIQUIDRAPE, 1998.

U.S. patent application Ser. No. 09/479,059, Clark et al., filed Jan. 2000.

U.S. patent application Ser. No. 09/099,457, Malofsky et al., filed Jun. 1999.

U.S. patent application Ser. No. 09/990,293, Malofsky et al., filed Nov. 2001.

U.S. patent application Ser. No. 09/430,176, Narang et al., filed Oct. 1999.

(List continued on next page.)

*Primary Examiner*—Gregory Huson
*Assistant Examiner*—Peter deVore
(74) *Attorney, Agent, or Firm*—Oliff & Berridge, PLC

(57) ABSTRACT

An applicator for dispensing adhesive material includes a container body holding the adhesive material and an applicator tip configured to permit improved control and economy in application of the adhesive.

61 Claims, 12 Drawing Sheets

U.S. PATENT DOCUMENTS

| | | | | |
|---|---|---|---|---|
| 3,178,379 | A | 4/1965 | Wicker, Jr. et al. | |
| 3,223,083 | A | 12/1965 | Cobey | |
| 3,260,637 | A | 7/1966 | Von Bramer | |
| 3,468,458 | A | 9/1969 | Leigh | |
| 3,527,841 | A | 9/1970 | Wicker, Jr. et al. | |
| 3,559,652 | A | 2/1971 | Banitt et al. | |
| 3,722,599 | A | 3/1973 | Robertson et al. | |
| 3,728,375 | A | 4/1973 | Coover, Jr. et al. | |
| 3,759,264 | A | 9/1973 | Coover, Jr. et al. | |
| 3,770,523 | A | 11/1973 | Biswas | |
| 3,891,125 | A | 6/1975 | Morane et al. | |
| 3,922,100 | A | 11/1975 | Saito | 401/199 |
| 3,938,898 | A | 2/1976 | Reitknecht | |
| 3,940,362 | A | 2/1976 | Overhults | |
| 3,964,643 | A | 6/1976 | Morane et al. | |
| 3,970,505 | A | 7/1976 | Hauser et al. | |
| 3,995,641 | A | 12/1976 | Kronenthal et al. | |
| 4,042,442 | A | 8/1977 | Dombroski et al. | |
| 4,138,040 | A | 2/1979 | Stock | |
| 4,210,246 | A | 7/1980 | Kuchenbecker | |
| 4,291,131 | A | 9/1981 | McIntire et al. | |
| 4,297,160 | A | 10/1981 | Kusayama et al. | |
| 4,329,990 | A | 5/1982 | Sneider | |
| 4,340,708 | A | 7/1982 | Gruber | |
| 4,364,876 | A | 12/1982 | Kimura et al. | |
| 4,408,699 | A | 10/1983 | Stock | |
| 4,707,450 | A | 11/1987 | Nason | |
| 4,747,719 | A | 5/1988 | Parkin | |
| 4,777,230 | A | 10/1988 | Kamath | |
| 4,783,515 | A | 11/1988 | Waniczek et al. | 526/297 |
| 4,801,008 | A | 1/1989 | Rich | |
| 4,804,691 | A | 2/1989 | English et al. | |
| 4,875,602 | A | 10/1989 | Chickering et al. | |
| 4,957,385 | A | 9/1990 | Weinstein | |
| 5,029,738 | A | 7/1991 | Dillon | 222/527 |
| 5,059,657 | A | 10/1991 | Druliner et al. | |
| 5,106,221 | A | 4/1992 | Diot et al. | 401/132 |
| 5,120,301 | A | 6/1992 | Wu | |
| 5,152,742 | A | 10/1992 | Simpson | |
| 5,199,808 | A | 4/1993 | Gueret | 401/133 |
| 5,216,096 | A | 6/1993 | Hattori et al. | |
| 5,219,328 | A | 6/1993 | Morse et al. | |
| 5,230,579 | A | 7/1993 | Klawson et al. | 401/205 |
| 5,259,835 | A | 11/1993 | Clark et al. | |
| 5,262,200 | A | 11/1993 | Puder et al. | |
| 5,328,687 | A | 7/1994 | Leung et al. | |
| 5,333,755 | A | 8/1994 | Wang et al. | 222/1 |
| 5,445,462 | A | 8/1995 | Johnson et al. | |
| 5,514,371 | A | 5/1996 | Leung et al. | |
| 5,514,372 | A | 5/1996 | Leung et al. | |
| 5,575,997 | A | 11/1996 | Leung et al. | |
| 5,582,834 | A | 12/1996 | Leung et al. | |
| 5,624,669 | A | 4/1997 | Leung et al. | |
| 5,816,804 | A | 10/1998 | Fischer | |
| 5,857,991 | A | 1/1999 | Grothoff et al. | |
| 5,928,611 | A | 7/1999 | Leung | |
| 5,934,522 | A | 8/1999 | Canela et al. | |
| 6,143,352 | A | 11/2000 | Clark et al. | |
| 6,352,704 | B1 | 3/2002 | Nicholson et al. | |
| 6,425,704 | B2 * | 7/2002 | Voiers et al. | 401/196 |

OTHER PUBLICATIONS

U.S. patent application Ser. No. 09/430,180, Nicholson et al., filed Oct. 1999.

U.S. patent application Ser. No. 09/385,030, D'Alessio et al., filed Aug. 1999.

U.S. patent application Ser. No. 09/430,289, D'Alessio et al., filed Oct. 1999.

U.S. patent application Ser. No. 09/430,290, D'Alessio et al., filed Oct. 1999.

* cited by examiner

ADHESIVE APPLICATORS WITH IMPROVED APPLICATOR TIPS

This application is a continuation-in-part of U.S. application Ser. No. 09/479,060, filed Jan. 7, 2000, now U.S. Pat. No. 6,425,704 the entire disclosure of which is incorporated herein by reference.

BACKGROUND OF THE INVENTION

1. Field of Invention

This invention relates to adhesive applicators with new and improved applicator tip designs.

2. Description of Related Art

Monomer and polymer adhesives are used in both industrial (including household) and medical applications. Included among these adhesives are the 1,1-disubstituted ethylene monomers and polymers, such as the α-cyanoacrylates. Since the discovery of the adhesive properties of such monomers and polymers, they have found wide use due to the speed with which they cure, the strength of the resulting bond formed, and their relative ease of use. These characteristics have made the α-cyanoacrylate adhesives the primary choice for numerous applications such as bonding plastics, rubbers, glass, metals, wood, and, more recently, biological tissues.

It is known that monomeric forms of α-cyanoacrylates are extremely reactive, polymerizing rapidly in the presence of even minute amounts of an initiator, including moisture present in the air or on moist surfaces such as animal (including human) tissue. Monomers of α-cyanoacrylates are anionically polymerizable or free radical polymerizable, or polymerizable by zwitterions or ion pairs to form polymers. Once polymerization has been initiated, the cure rate can be very rapid.

Medical applications of adhesive compositions include use as an alternate or an adjunct to surgical sutures and staples in wound closure as well as for covering and protecting surface wounds such as lacerations, abrasions, burns, ulcers such as stomatitis, sores, and other open surface wounds. When such an adhesive is applied, it is usually applied in its monomeric form, and the resultant polymerization gives rise to the desired adhesive bond.

However, with the application of adhesive in a monomeric form, due to the rapid polymerization rate of the monomers, it has been challenging to design effective and commercially viable packaging and dispensing systems. Such packaging and dispensing systems must counterbalance the competing requirements that the monomer not prematurely polymerize, that the monomer be easily applied, that the monomer polymerize at a desired rate upon application, and that the sanitary and/or sterile properties of the monomer and applicator—whether real or perceived—be maintained.

Various dispensing and packaging systems for adhesives have been proposed. These systems include large bottles with a single applicator, such as a large single- or multi-use brush; small applicators such as small ampoules containing monomer that can be expelled through an integral or replaceable applicator; and the like.

A disadvantage of some known applicator systems, and particularly applicators containing a frangible vial and a porous applicator tip for expelling the adhesive, is that monomer material may be wasted by filling the pores of the applicator tip in areas other than the areas used to apply the adhesive. Furthermore, some known applicator tips suffer from the problem of the monomer being expelled through the entire surface area of the tip, and even to greater extents in areas other than the area used to apply the monomer to the desired substrate. For example, large amounts of adhesive are expelled from areas around the periphery of the applicator tip, where the applicator tip meets the applicator housing, rather than through the end of the applicator tip, as is often desired. This leads to a further problem of less precise control over the area of application of the monomer to the substrate.

For example, an effective applicator system is disclosed in U.S. Pat. No. 5,928,611 to Leung. This patent discloses an applicator system generally comprising a tube containing a frangible vial of monomeric adhesive composition. One end of the tube is sealed, and the other end is closed by an applicator tip comprising a solid support having a polymerization or cross-linking accelerator or initiator for the monomeric adhesive disposed thereon or therein. As shown in FIG. 3 of the patent, the applicator tip can be generally dome shaped. The applicator device of U.S. Pat. No. 5,928,611 is shown as FIG. 1 herein. An applicator device 100 comprises a cylindrical applicator container 200 holding polymerizable and/or cross-linkable material 300 enclosed in a frangible vial 400, and an applicator tip 500 containing a polymerization and/or cross-linking initiator.

However, a difficulty encountered with such a dome-shaped applicator tip, as well as with other solid applicator tips, is that the monomeric adhesive material being expelled through the applicator tip tends to follow paths of least resistance within the tip. That is, as the monomeric adhesive is being expelled, it tends to follow the shortest paths through the tip, which tend to be around the periphery of the tip, rather than following the longer path through the full length of the tip to the end of the tip. Because the end of the tip is desired to be used to apply the adhesive, less precise control of placement of the adhesive is obtained because adhesive is expelled through the entire surface of the tip. This also tends to result in waste of adhesive material, because all of the adhesive does not exit from the tip at the desired location.

A related problem with such applicator tips is that it is difficult to obtain precise placement of the adhesive materials in some uses. For example, it is often difficult to precisely apply the adhesive material in confined spaces, where it is difficult to fit the entire applicator device. Likewise, it is difficult to apply fine lines of the adhesive from such a dome-shaped applicator tip. In such medical procedures as face lifts or intricate surgery, for example, high precision is necessary.

Applicator devices used for Loctite Product No. 11067-2 and Permatex Product No. ATA-1 contain crushable glass ampoules within flexible applicators. However, the compositions within the crushable ampoules are, in both products, adhesive activators, not the adhesive composition itself. In both of these products, the adhesive is contained in a separate dispenser. The dispenser system used for these products is physically similar to that shown in FIG. 1, except that the applicator tip is rectangular in shape, rather than dome-shaped, and the applicator tip does not contain a polymerization and/or cross-linking initiator for an adhesive material contained in the frangible vial. In this product also, the above-described problems of wasted material (here, activator) and less precision in application are also present.

EP 0 170 526 discloses an applicator device for storing and dispensing a two-component product, such as a two-component adhesive. The applicator includes an inner sealed frangible ampoule containing a curable material, an outer flexible sleeve containing the ampoule, with a dispensing nozzle at one end and being sealed at the other end, and a fibrous material impregnated with accelerant. The fibrous material is positioned at least partly around the ampoule at the orifice end of the container between the ampoule and a nozzle.

Accordingly, a need exists in the art for adhesive applicators that will allow more precise placement of the adhesive material. A need also exists in the art for a means to decrease waste of monomeric adhesive material. Still further, a need exists in the art for different types of applicator tip designs, to allow a broader range of use of the adhesive materials.

SUMMARY OF THE INVENTION

The present invention addresses the above and other needs by providing applicator tips that allow increased precision in control of placement of the adhesive composition, a decrease in waste of adhesive, and improved mixing of adhesive with additives. Applicator tips of embodiments of the present invention can direct the adhesive material that is being expelled from the applicator to a specific desired point, without the adhesive being expelled through an entire surface of the applicator tip. Applicator tips of embodiments of the present invention can mix the adhesive with one or more additives to achieve substantially homogeneous properties.

A benefit provided by the present invention is thus the ability to apply adhesive material in precise patterns, such as in thin lines, which was either more difficult or not possible using prior applicator systems, in addition to the ability to apply adhesive material to large areas. The present invention also allows tailoring of the application pattern based on alternative designs of the applicator tip, thus allowing flexibility in application of, for example, from thin lines to thicker lines. The present invention also permits decreased waste of adhesive material, by allowing effective use of a greater portion of the volume of adhesive material contained within the applicator. The present invention can also provide significantly improved mixing, either prior to or during application of the adhesive material.

In embodiments, the present invention provides an applicator for dispensing adhesive material, comprising: a container body containing an adhesive material, wherein said adhesive material is a synthetic or semi-synthetic polymerizable or cross-linkable monomer material; a body of porous material, wherein said adhesive material is located in said container body in a non-contacting relationship with said porous material prior to dispensing said adhesive material; and an applicator tip having an open end open toward said container body and at least one orifice, wherein at least a portion of said porous material is located in said open end of said applicator tip and wherein said applicator tip permits said adhesive material to pass through said porous material and exit said applicator tip at said at least one orifice.

In embodiments, the present invention provides an applicator for dispensing adhesive material, comprising: a container body containing an adhesive material, wherein said adhesive material is a synthetic or semi-synthetic polymerizable or cross-linkable monomer material; a body of porous material, wherein said adhesive material is located in said container body in a non-contacting relationship with said porous material prior to dispensing said adhesive material; and an applicator tip having an open end open toward said container body and at least one orifice, wherein at least a portion of said porous material is located in said open end of said applicator tip and wherein said applicator tip permits said adhesive material to pass through said porous material and exit said applicator tip at said at least one orifice; and at least one breaking means located on at least one of said porous material, said applicator tip and said container body for breaking a container of said adhesive material contained in said container body.

In embodiments, the present invention provides an applicator for dispensing adhesive material, comprising: a container body containing an adhesive material, wherein said adhesive material is a synthetic or semi-synthetic polymerizable or cross-linkable monomer material; a body of porous material, wherein said adhesive material is located in said container body in a non-contacting relationship with said porous material prior to dispensing said adhesive material, said porous material located adjacent an end of said container body having at least one orifice such that said adhesive material passes through said porous material to exit at said at least one orifice; and an applicator head comprising an arm extending from said container body and terminating with an applicator tip. The applicator may further comprise a flow control member in communication with said at least one orifice and arranged to deliver said adhesive dropwise to said applicator tip. In embodiments, the flow control member comprises one of a mesh, a grid and at least one roller.

In embodiments, the present invention provides a kit for dispensing adhesive material, comprising at least one saleable package containing: at least one applicator comprising: a container body and an adhesive material located in said container body; and at least one applicator tip that is attachable to said at least one applicator.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

Figure 1:
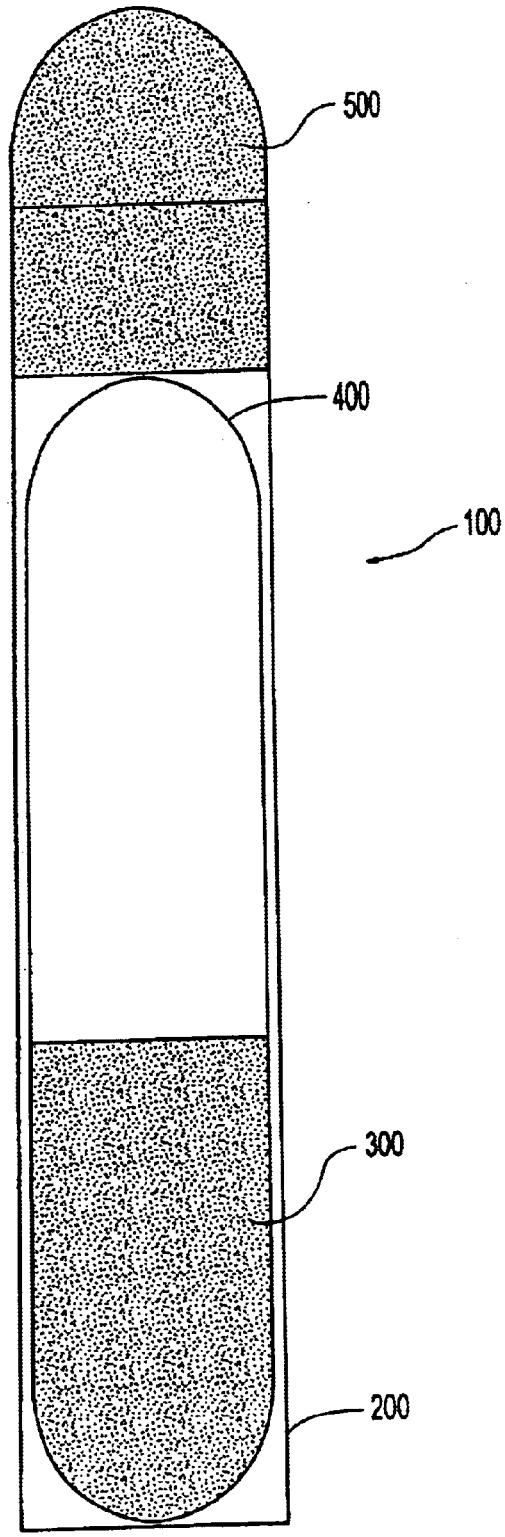
FIG. 1 PRIOR ART
FIG. 1 is a side elevational view of an applicator device according to the prior art.

The present invention provides adhesive applicators with improved applicator tips, suitable for use in applicator devices of the type shown in FIG. 1, which provide significant improvement in the application and use of adhesive material. Such applicator tips can be used, for example, in combination with the adhesive compositions and packaging and dispensing systems set forth in U.S. Pat. No. 5,928,611, the entire disclosure of which is incorporated herein by reference. Of course, other adhesive compositions, compatible with the applicators of the present invention, can also be used.

According to the present invention, various applicator tips are provided that can be used to more precisely and economically apply adhesive material at the desired application site. Applicator tips of the present invention can be used on any of a wide variety of applicator devices, and are particularly suitable for use on applicator devices disclosed in the above-referenced U.S. Pat. No. 5,928,611. Other known applicator bodies, such as squeeze tubes and syringes, are also amenable to use in some embodiments of the present invention The applicator can in all embodiments, but need not in all embodiments, include a shaped body of porous material. The porous shaped body can be, or can be replaced by, a filter element. The filter element can filter out any glass shards or other solids that may be present in the adhesive composition. The filter or porous shaped body may also contain polymerization and/or cross-linking initiators and/or rate modifiers, e.g., accelerators or inhibitors, for the adhesive material, if desired. Suitable porous shaped bodies are disclosed, for example, in U.S. Pat. No. 5,928,611 and in copending application Ser. No. 09/479,059, the entire disclosures of which are incorporated herein by reference.

In general, applicator tips according to the present invention include a first portion, which is substantially form-fit to a part of the applicator, such as the applicator body, and a second part, which is substantially not form-fit to the applicator, that forms an extension portion generally away from the applicator body. The first form-fit portion facilitates attachment of the applicator tip to the applicator, whereas the second extension portion provides structure for applying the adhesive material to the desired surface.

As used herein, the terms "attach" or "attached" as referring to the applicator tip means operably connecting the applicator tip to the applicator body, or parts thereof, directly or through other components. Thus, for example, the applicator tip can be attached to the applicator body in any suitable way, including but not limited to mechanical arrangements such as luer locks, threads or locking rings, pressure and/or friction fitting, adhesive or chemical arrangements such as adhesive or chemical bonding, heat-shrink attachment, ultrasonic welding, and the like.

The applicator tip is generally of a rigid or semi-rigid material, to permit controlled delivery of the monomeric adhesive material to the desired application site. Suitable materials for forming the applicator tip include, but are not limited to, natural materials such as cellulose, cardboard, metal, ceramic, glass, plastics such as butyrate or high density polyethylene, polypropylene, polyester, or the like. Preferably, the applicator tip is made of a non-porous material and has a decreased affinity for the monomeric adhesive. That is, the applicator tip preferably does not readily absorb or adsorb large amounts of the monomeric adhesive material being expressed through the applicator tip, which would otherwise tend to leave residual material in the applicator tip. Less porosity of the applicator tip is preferred because it has been found that when the porous member is exposed to the environment, adhesive material being expressed through the porous member tends to harden and clog the porous member in the exposed areas. However, by using a less-porous material attached to the porous member, and having less of the porous member exposed to the environment, the problem of hardening and clogging in the porous member can be decreased or avoided.

Exemplary embodiments of the present invention are shown in FIGS. 2–10, although according to embodiments of the present invention, the applicator can generally assume different shapes and designs, as desired. As shown in FIGS. 2*a* and 2*b*, some embodiments of the applicator device 10 comprise an applicator container or body 20 holding polymerizable and/or cross-linkable adhesive material 30, such as enclosed in a frangible vial 40. One end of the applicator device 10 is sealed, and the other end of the applicator device 10 is fitted with a suitable shaped body of porous material 50, which can contain a polymerization and/or cross-linking initiator for the polymerizable and/or cross-linkable material 30. An applicator tip 60 is attached to the shaped body end of the applicator body. The applicator tip can be attached on the outside of the applicator body, as shown in FIG. 2*a*, or can be attached on the inside of the applicator body, as shown in FIG. 2*b*. The applicator tip 60 has an orifice or opening 70, for dispensing adhesive material from the applicator.

Figure 2A:
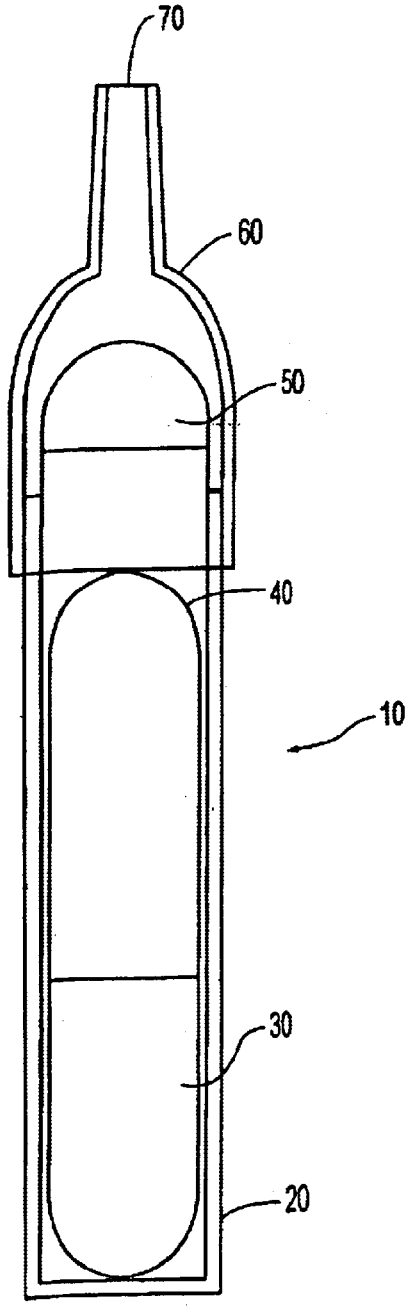
FIGS. 2*a*–2*d* are side elevational views of applicator devices according to the present invention.
Figure 2B:
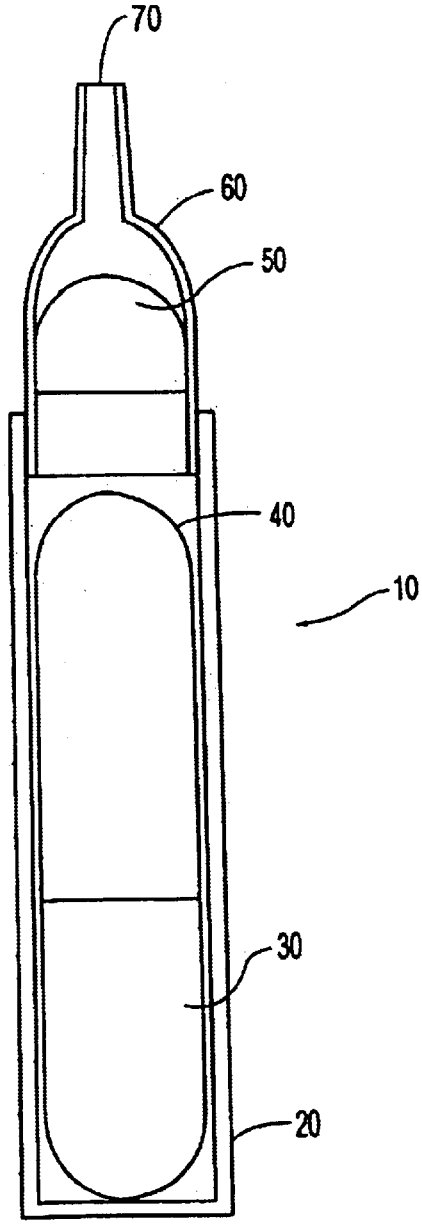
Figure 2C:
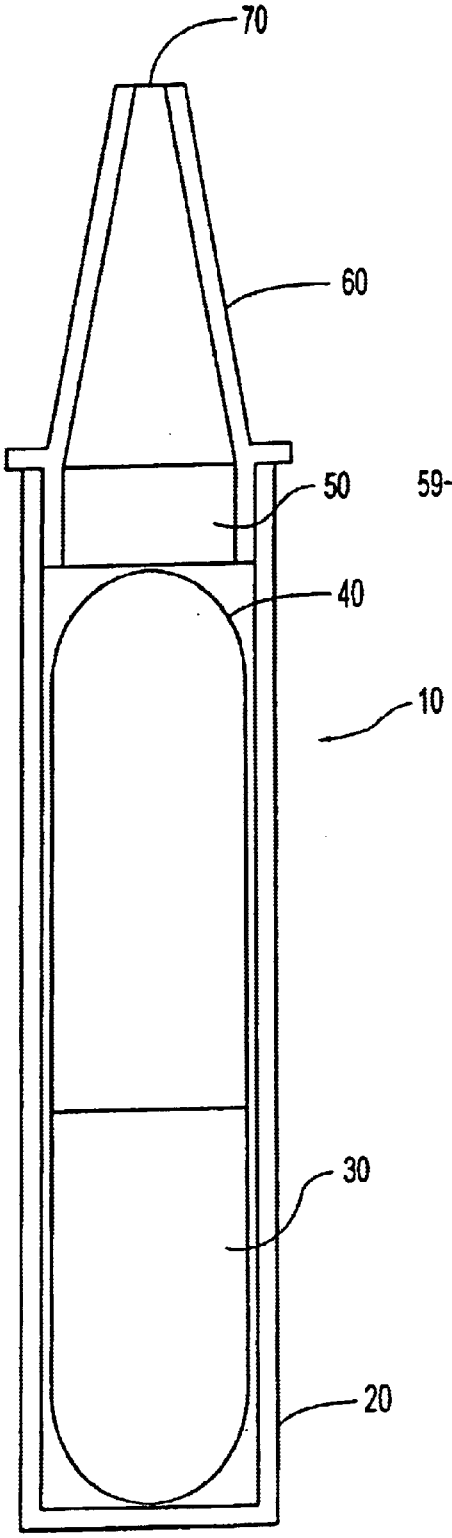
Figure 2D:
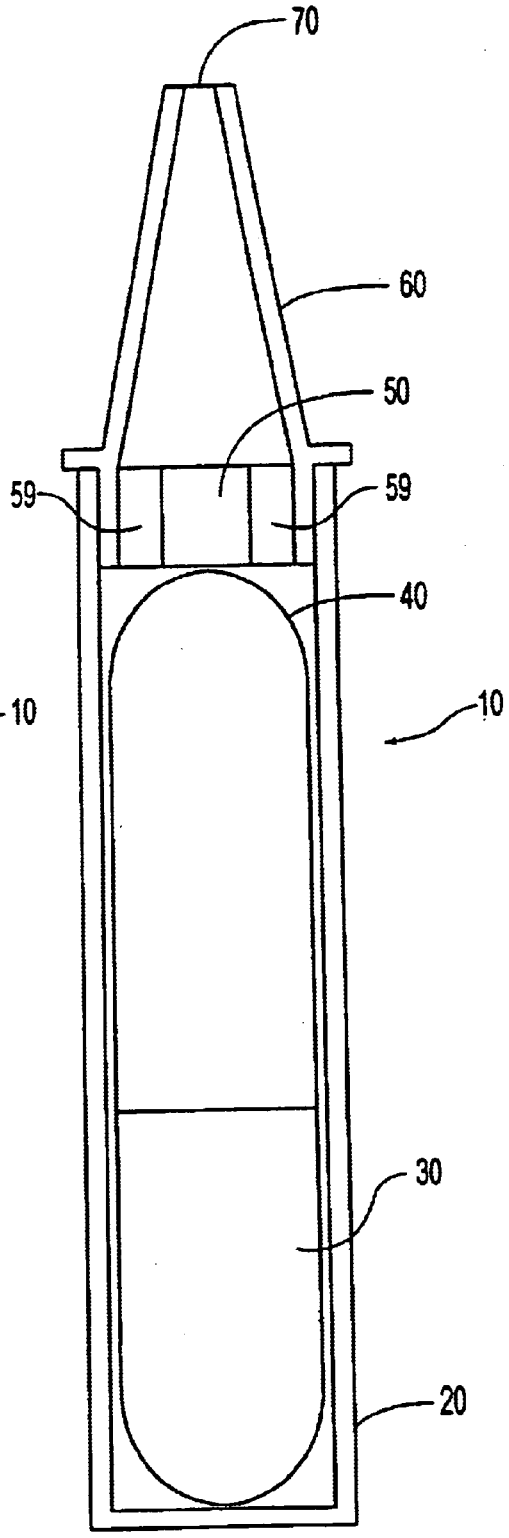

As shown in FIGS. 2*c* and 2*d*, the porous material 50 can be incorporated into the applicator 10 in various ways. Preferably, when the porous material is included, it is located and/or attached radially inwardly of a portion of the applicator tip 60. Thus, for example, as shown in FIG. 2*c*, the porous material 50 can be attached directly to an inside surface of the applicator tip 60, which can in turn be attached to an inside surface of the applicator container or body 20, or to an upper rim of the applicator container or body 20.

Alternatively, in embodiments as shown in FIG. 2*d*, the porous material 50 can be attached to a holding member 59, which is itself attached to an inner surface of the applicator directly or to an inside surface of the applicator tip 60, which itself is attached to the applicator container or body 20. In these embodiments, the holding member 59 may be formed from any suitable material, and is preferably formed from a material that is less porous and/or less pervious to the adhesive material than is the porous material, and preferably substantially impervious to the adhesive material. The material may be the same or different from the above-described tip materials. Such embodiments may be preferred, for example, where it is desired to provide a narrower passageway for the adhesive material through the porous material or to accommodate optional use of the porous material.

Figure 3A:
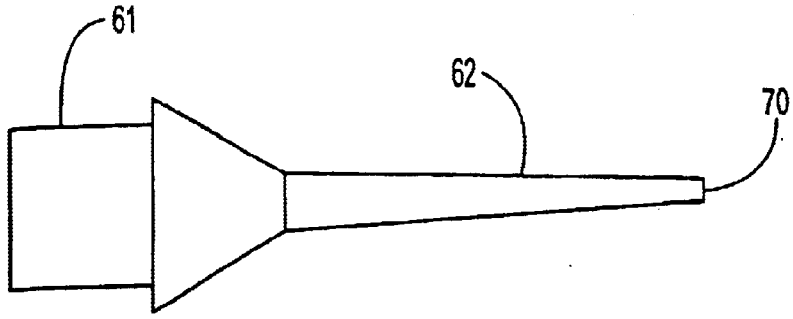
FIGS. 3*a*–3*c* are elevational views of applicator tip designs according to the present invention.
Figure 3B:
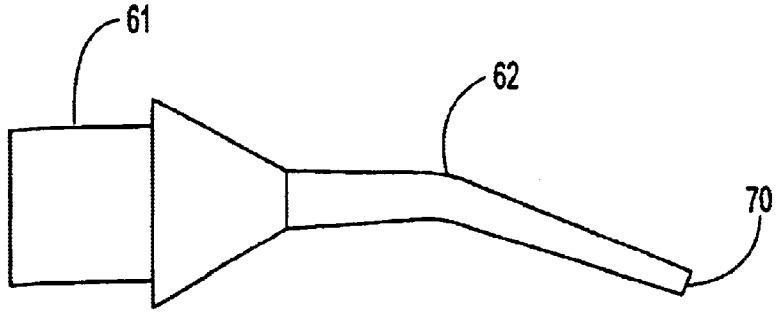
Figure 3C:
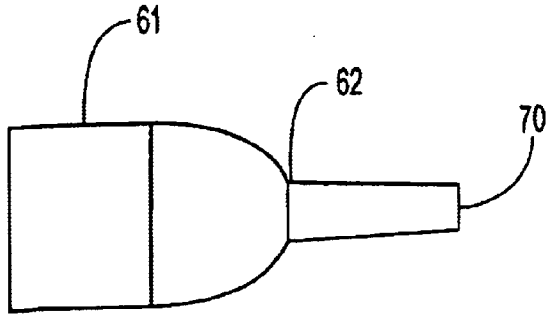

As shown in FIGS. 3*a*–3*c*, the applicator tip includes a connection portion 61, located at the proximal end of the applicator tip where the applicator tip attaches to the applicator body, and an extension or application portion 62, located toward the distal end of the applicator tip. As used herein, the proximal end refers to the end of the applicator tip that is attached to, inserted into, or closest to the applicator body, and the distal end refers to the opposite end of the applicator tip. An orifice 70, which may be of any desired shape and size, is generally located at the end of the application or extension portion 62. For example, FIG. 3*a* shows the applicator tip as having a fine orifice 70 at the distal end of the applicator tip, suitable for applying a fine line of adhesive, or for applying adhesive with high accuracy of placement. The applicator tip of FIG. 3*b* is similar to the applicator tip of FIG. 3*a*, but shows that the applicator tip can be bent at any desired angle, to provide ease of use in applying the monomeric adhesive material to the desired surface and/or for applying the monomeric adhesive material in confined spaces. Likewise, FIG. 3*c* shows that the orifice can be of a larger size, for example for cases where a thicker line or area of adhesive is to be applied.

According to the present invention, the applicator tip can have any desired length, so long as the applicator tip is still effective in dispensing the monomeric adhesive material. Thus, for example, the applicator tip should not be so long so as to be ineffective in delivering the monomeric adhesive material through the tip. Likewise, the orifice can be of any desired size, and can be adjusted for various desired applications. Preferably, the orifice should be sized such as to provide enough resistance to flow of the adhesive material therethrough that the adhesive material does not exit on its own such as when the applicator is inverted. Of course, as will be apparent, the orifice dimensions will accordingly depend on the viscosity of the adhesive material.

Figure 4:
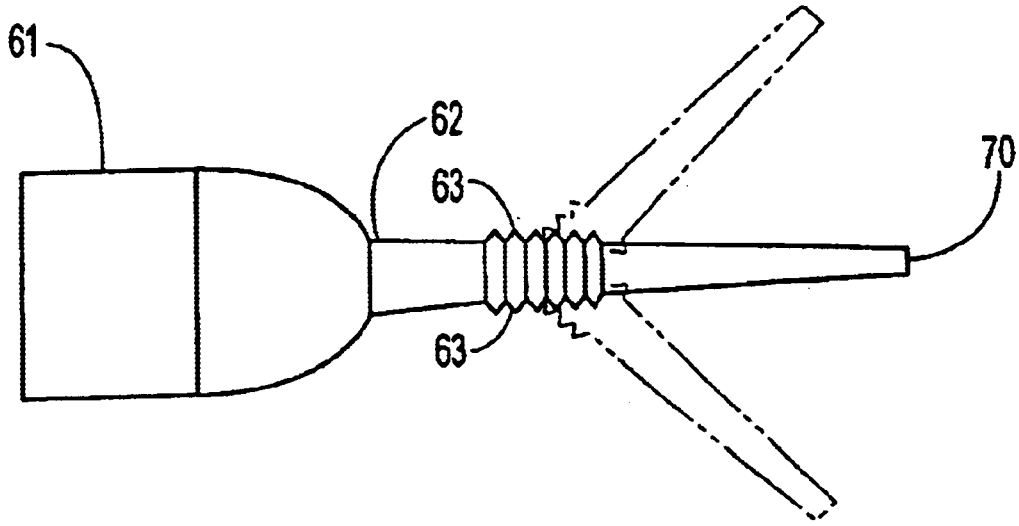
FIG. 4 is an elevational view of an applicator tip according to the present invention including an accordian section.
Figure 5A:
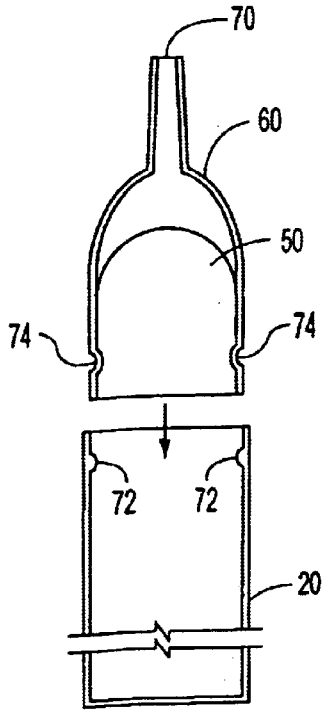
FIGS. 5*a*–5*d* are elevational views showing attachment of an applicator tip to an applicator body.
Figure 5B:
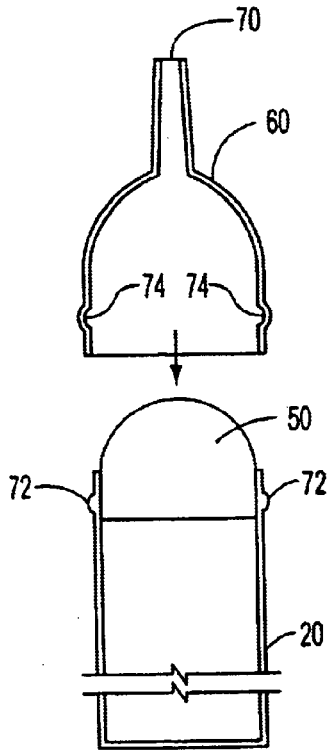
Figure 5C:
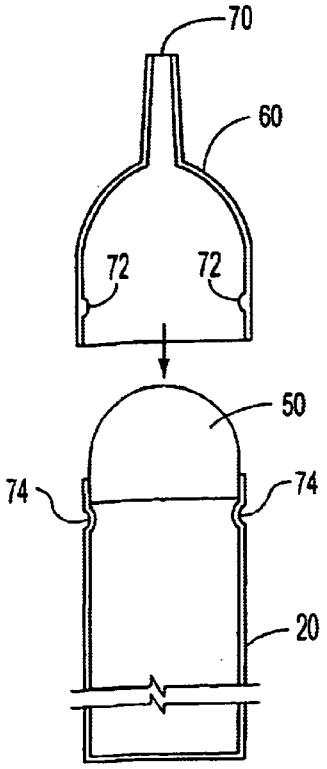
Figure 5D:
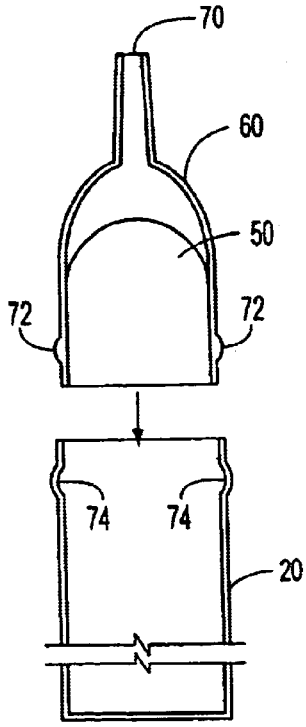

In embodiments of the present invention, the applicator tip can be provided with one or more accordian-type sections, which permit expansion or contraction of the applicator tip length, and/or adjustment of the applicator tip shape by the user. Such an embodiment is shown, for example, in FIG. 4. FIG. 4 shows the applicator tip as including a connection portion 61, an extension or application portion 62, and an orifice 70. FIG. 4 also shows the presence of two accordian portions 63, located on opposite sides of the applicator tip. Adjustment of these accordian portions allows the applicator tip to be extended or contracted, or to be rotated to various angles with respect to the applicator body.

Thus, use of such an accordian section in the applicator tip, or other suitable expansion/bending mechanism, provides significant benefits to the applicator system as a whole. In particular, the accordian design permits the user to adjust the length and shape of the applicator tip to any desired amount, thereby allowing the user to tailor the applicator device to the circumstances of any given use. Furthermore, packaging of the applicator device is simplified, because the shorter, compressed, straight applicator tip is small and more compact than a longer, expanded, bent applicator tip.

According to the present invention, the applicator tip can be permanently or replaceably attached to the applicator body in various ways. For example, the applicator tip can be attached to the applicator body either on the outside of the applicator body, or on the inside of the applicator body. In both instances, the applicator tip can be, for example, adherently bonded to the applicator body, can be attached to the applicator body by heat-shrinking the applicator tip onto the applicator body or heat-shrinking the applicator body onto the applicator tip, can be attached onto or into the applicator body by suitable mechanical means, including luer locks, threads or locking rings (not shown) or can be held to the applicator body by pressure and/or friction. Adherent or heat-shrink attachment may be preferred in embodiments where the applicator tip is not to be interchangeable, or where the applicator tip is attached during the manufacturing process. However, screw, locking or friction/pressure attachment may be preferred in embodiments where interchangeability is desired, such as where different sizes or types of applicator tips are available for a given applicator body. Such interchangeable tips can be used, for example, to provide possible selection of different application profiles of the adhesive material.

One particularly suitable means for attaching the applicator tip to the applicator body is to use snap edges or locking rings on one of the applicator body or the applicator tip, with mating members on the other of the applicator body or the applicator tip. For example, suitable configurations for attaching an applicator tip to an applicator body are shown in FIGS. 5*a*–5*d*. In each of FIGS. 5*a* to 5*d*, the applicator is shown as having an applicator body 20, a porous shaped body 50, and an applicator tip 60 having an orifice 70. Each of the applicators also has a male mating ring or tabs 72 or a female mating ring or recesses 74, and the applicator tip has the other of the male mating ring or tabs 72 or a female mating ring or recesses 74. Thus, for example, the applicator tip 60 snaps over the applicator body 20 in the embodiments of FIGS. 5*b* and 5*c*, while the applicator tip 60 snaps into the applicator body 20 in the embodiments of FIGS. 5*a* and 5*d*. Of course, these embodiments are not limited to the use of mating rings or tabs, as shown in FIGS. 5*a*–5*d*, but instead apply to various structures for attaching the applicator tip to the applicator body.

Figure 6A:
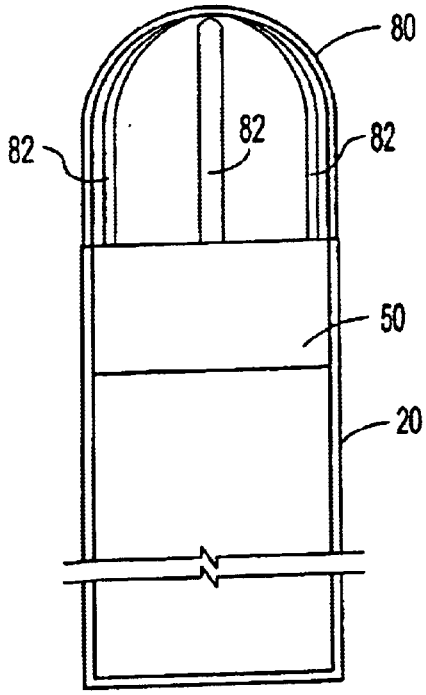
FIGS. 6*a*–6*b* are elevational views showing applicator tips according to the present invention.
Figure 6B:
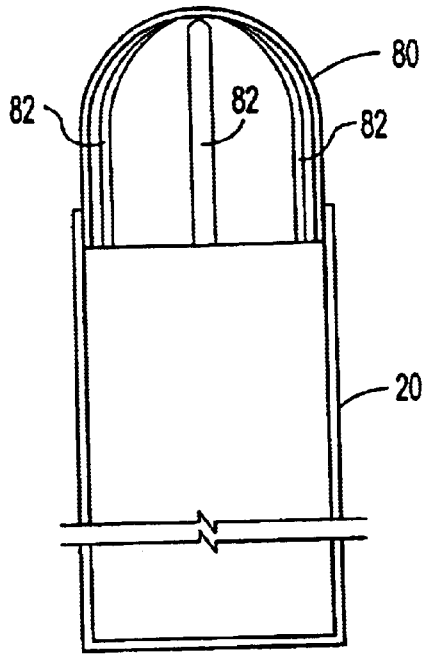

In a further embodiment of the present invention, the applicator tip need not be a hollow element as described above. This embodiment is depicted, for example, in FIGS. 6*a* and 6*b*. As shown in FIG. 6*a*, the applicator tip is a solid or hollow element, which is preferably non-porous, or less porous than the porous material. Thus, as shown in FIG. 6*a*, the applicator includes an applicator body 20, a shaped body of porous material 50 and an applicator tip 80. Alternatively, as shown in FIG. 6*b*, the porous material need not be included, if desired. Thus, as shown in FIG. 6*b*, the applicator includes an applicator body 20 and an applicator tip 80.

Figure 6C:
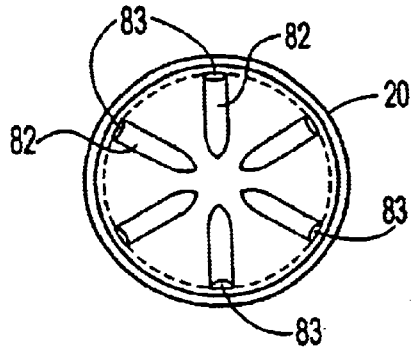
FIG. 6*c* is a top view of the applicator tip of FIG. 6*b;*

The applicator tip 80 includes grooves 82 on the surface thereof. A top view of the applicator of FIG. 6*b* is shown in FIG. 6*c*. In FIG. 6*c*, the applicator tip 80 is attached to the inside of applicator body 20. Grooves or channels 82 formed in the external surface of the applicator tip 80 converge toward the end of the applicator tip 80. These grooves or channels 82 form openings 83 into the interior of the applicator body, through which the adhesive material is expressed. Of course, although FIG. 6*c* shows the applicator tip as having six semi-circular shaped grooves, the present invention is not limited to such embodiments, and more or fewer grooves, or other surface textures, can be used as desired. Furthermore, the placement and depth of the surface texture can be used to control the size of the openings 83 into the interior to the applicator body, as will be apparent to those skilled in the art.

Preferably, the applicator tip is either non-porous, or substantially non-porous so as not to absorb or adsorb a significant amount of the adhesive material. Thus, the applicator tip may be formed such that the adhesive material preferentially exits the applicator through the formed openings, to travel around the outside surface of the applicator tip, rather than entering into the applicator tip itself. In embodiments, the applicator tip is thus preferably impervious to the adhesive material.

In embodiments where it may be desired, such as where the applicator tip is non-porous or substantially non-porous, it is acceptable to incorporate a desired amount of polymerization or cross-linking initiator or rate-modifier for the adhesive material on the surface of the applicator tip. In this manner, as the adhesive material flows over the surface of the applicator tip, it contacts the polymerization or cross-linking initiator or rate-modifier. In embodiments, the polymerization or cross-linking initiator or rate-modifier can be placed on the surface of the applicator tip either over an entire surface of the tip, or only in channels, grooves, or the like on or in such surface.

The solid element can be attached to the applicator body directly or through the porous element by any suitable means, including the various means described above for attaching the applicator tip to the applicator body.

In order to increase flow of adhesive from the porous shaped body, and around the surface of the applicator tip to the desired application area, various surface features can be included on the applicator tip. For example, grooves can be incorporated into the surface of the applicator tip, to channel adhesive exiting the porous element around the applicator tip. Where grooves are used, such grooves can be of any desired configuration including, but not limited to, v-shaped, u-shaped, square, semi-circular, semi-oval, or the like. Preferably, the grooves should match up with exposed portions of the porous member, such that adhesive material exiting the porous member is directly channeled into the grooves. In addition, the grooves or channels can be formed such that they are exposed on the surface, or they can be formed to be located beneath the surface of the solid element.

In this and other embodiments of the present invention, it is preferred that a majority of the porous shaped body be covered by the walls of the applicator body. That is, it is preferred that a majority of the length of the porous shaped body be inserted into the applicator body, such that the walls of the porous shaped body are not exposed to the atmosphere during normal use. In embodiments, it is preferred that at least 75%, or 80% or 90% of the length of the porous shaped body be inserted into the applicator body. In other embodiments, it is preferred that the porous shaped body is completely or substantially inserted into the applicator body. In this manner, less of the porous shaped body is exposed to the environment, and problems of clogging of the porous shaped body and non-uniform flow through the porous shaped body can be alleviated.

Although the above embodiments have been described as being directed to an applicator wherein the applicator body is a sealed vessel that includes a frangible ampoule containing the adhesive material, the invention is not limited to such embodiments. Rather, the applicator tips of the present invention can be used on a wide variety of adhesive dispensing applicators.

For example, the applicator tips of the present invention can be used in combination with an applicator where the applicator body includes a relatively larger supply of adhesive material. Such an applicator is particularly useful, for example, where the adhesive material is not a highly polymerizable material, and where the same supply of adhesive material can be used for multiple adhesive applications from the same applicator.

Applicator tips of the present invention can be used in combination with an applicator where the applicator body includes a container of adhesive material that is broken by a suitable structure in the applicator prior to use. This embodiment, for example, is useful where the adhesive material is contained in a rupturable container, which can be contained in a closed applicator body, or which can be inserted into an open end of an applicator body and is subsequently ruptured for use. For example, the container could be ruptured by a suitable projection attached to the porous shaped body and/or the applicator tip but projecting into the applicator body.

Figure 7:
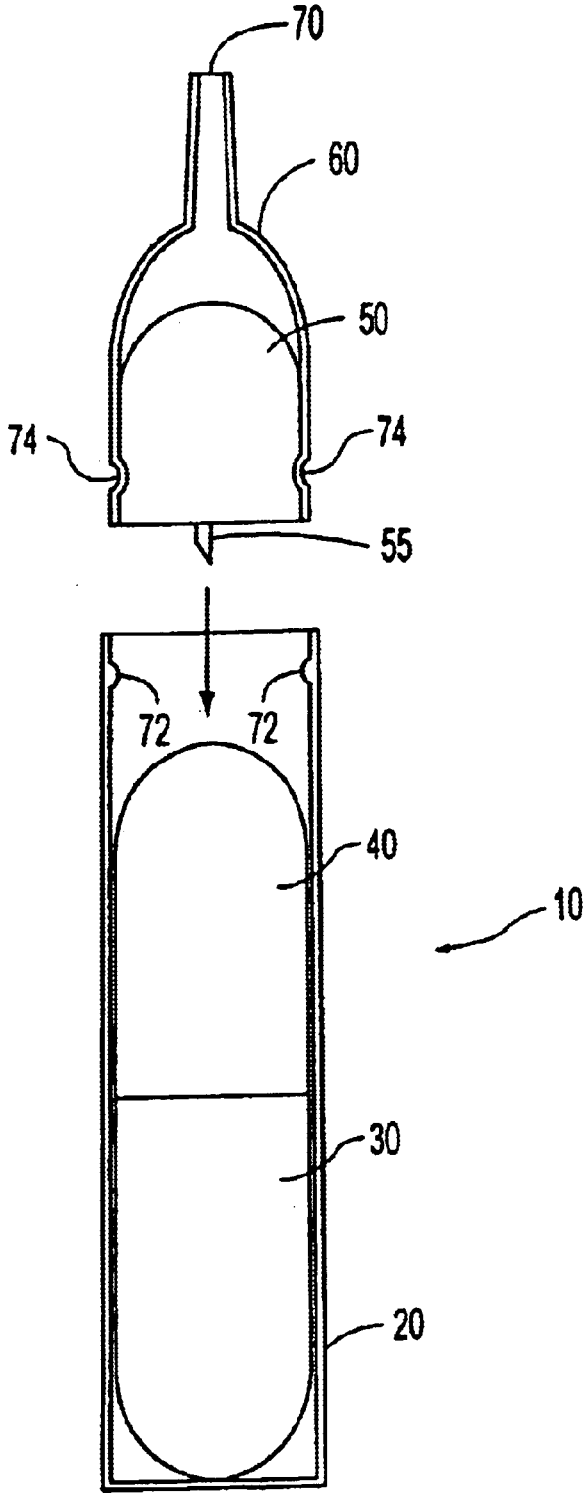
FIG. 7 is an elevational views showing an applicator according to the present invention.

An example of this embodiment is shown, for example, in FIG. 7. As shown in FIG. 7, the applicator device 10 comprises an applicator container or body 20, shown here as having an open upper end for receiving a container 40 of adhesive material 30. The other end of the applicator device 10 is closed. The container body 20 also includes a suitable attachment structure, such as a male mating device 72 described above, for receiving and engaging a suitable attachment structure, such as a female mating device 74 described above, on an applicator tip. Of course, the invention is not limited to these attachment structures, and other suitable modes of attachment can be readily used, as desired. A separate applicator tip assembly, which includes the applicator tip 60 and porous shaped body 50, is insertable into the container body 20. The porous shaped body can contain a polymerization and/or cross-linking initiator and/or rate modifier when the adhesive material 30 is a polymerizable and/or cross-linkable material. In addition, the porous shaped body 50 includes a spike, shown here as a hollow spike 55, which breaks or ruptures the container 40 of adhesive material 30 when the applicator tip is inserted into the container body 20. Once ruptured, the adhesive material exits the container 30 and passes through the porous shaped body 50, either through the hollow spike 55 or through other portions of the porous shaped body 50.

Figure 8A:
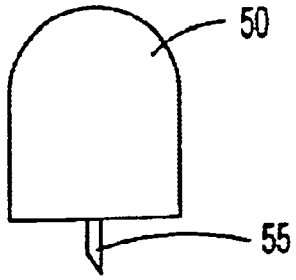
FIGS. 8*a*–8*e* are elevational views showing portions of applicator tips according to the present invention.
Figure 8B:
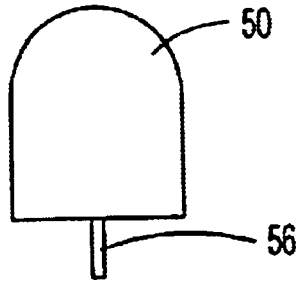
Figure 8C:
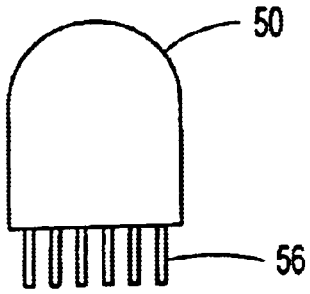
Figure 8D:
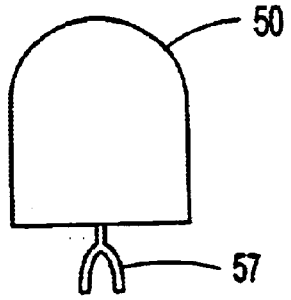

In these embodiments, the spike need not be hollow, but instead can be of any suitable shape, so long as it accomplishes the objectives of rupturing the adhesive container, and permitting the adhesive to pass through the applicator tip. For example, suitable exemplary rupture or breaking means are shown in FIGS. 8*a*–8*e*. Each of these figures shows only the shaped body 50 and the rupture or breaking means. For example, FIG. 8*a* shows a hollow spike design for the rupture means 55. However, as shown in FIGS. 8*b* and 8*c*, the rupture means can include one (FIG. 8*b*) or more than one (FIG. 8*c*) solid spikes or pins. Likewise, the rupture means can assume other more complex designs, such as shown in FIG. 8*d* as rupture means 57. This type of design may be preferable where the rupture means is not hollow, as it will create a larger opening in the adhesive container for the adhesive to exit the container and enter the shaped body 50.

Figure 8E:
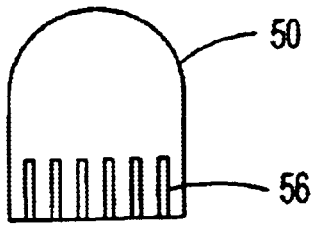

Still further, the present invention is not limited to rupture means that extend from the shaped body 50. Rather, as shown in FIG. 8*e*, any suitable rupture means may also be partially or fully embedded in a compressible shaped body 50. This design may be preferred, for example, to help prevent possible accidental rupture of the adhesive container or in embodiments where the applicator tip is interchangeable and sharp projections are not desired.

Figure 9:
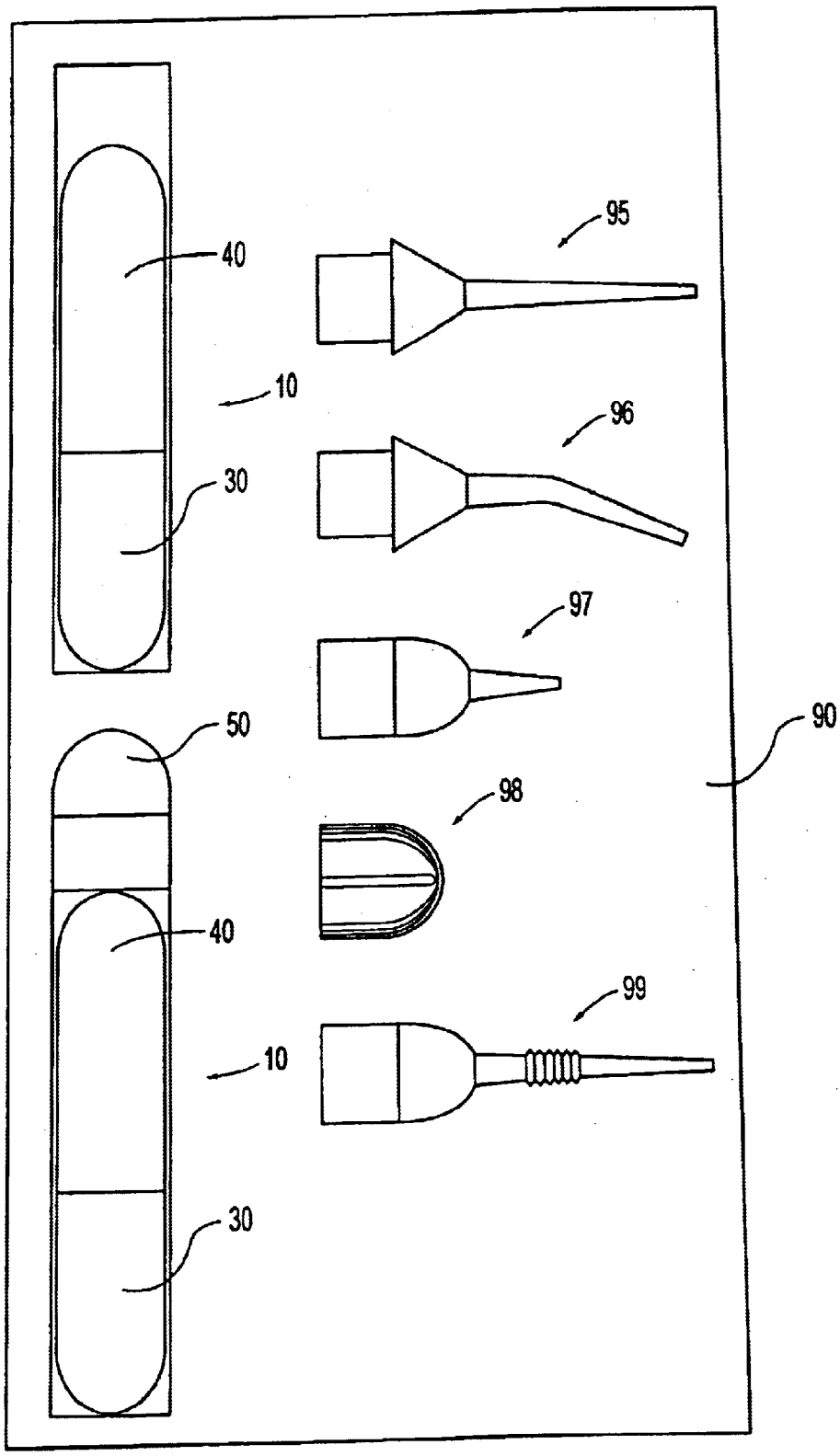
FIG. 9 is a side elevational view of a kit according to the present invention.

According to embodiments of the present invention, use of nonpermanent means of attaching the applicator tip to the applicator body are preferred for purposes of interchangeability. For example, interchangeable tips may give the user of the applicator the ability to select a desired applicator tip size and/or design for particular applications. Thus, the present invention provides for kits for dispensing adhesive material, where the kit can include one or more applicators or adhesive containers, and two or more applicator tips that are attachable to the adhesive containers. Preferably, as shown in FIG. 9, such kits will include one or more adhesive containers 10 and multiple applicator tips 95–99 of different sizes and/or designs in a saleable package 90, such as a blister pack, cardboard box, or the like, and will include more applicator tips than adhesive containers. Such kits can include any combination of the applicators and applicator tips.

In embodiments, the kit preferably includes a greater number of applicator tips than adhesive containers. In other embodiments, the kit can include the same number of applicator tips as adhesive containers, but the applicator tips can be of different sizes and/or different shapes. This allows the user to select an appropriate applicator tip based on the desired use of the adhesive material.

The contents of the kit can be packaged in any of a variety of ways, depending on the desired uses, marketing considerations, and the like. For example, the adhesive container and applicator tip can be packaged, such as in appropriate blister packs, individually, or in together in a combination package. Likewise, multiple individually packaged adhesive containers and/or applicator tips can be packaged together, such as in a bulk carton or in blister packs attached together at parting lines such as perforated parting lines.

Figure 10:
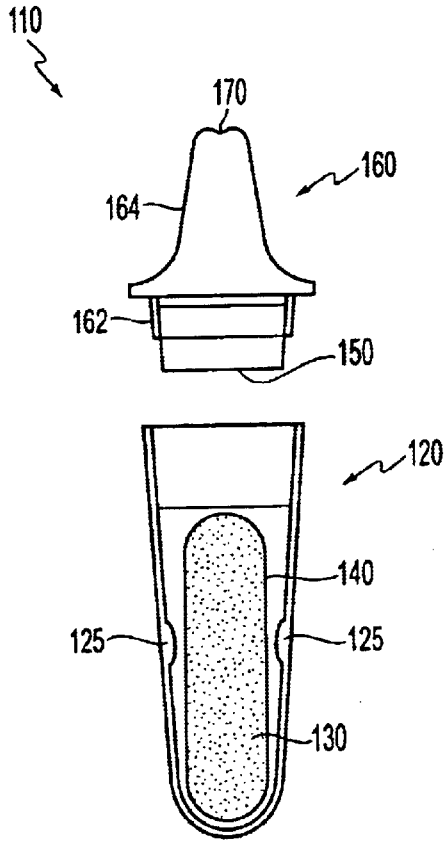
FIG. 10 is an exploded elevational view of another embodiment of the applicator devices according to the present invention.

FIG. 10 shows an exploded view of another embodiment of an applicator device 110 according to the present invention. The applicator device 110 comprises an applicator container or body 120 holding a polymerizable and/or cross-linkable adhesive material 130, such as enclosed in a frangible vial 140. One end of the applicator device 110 is sealed, and the other end of the applicator device 110 is open to receive an applicator tip 160 that includes a body of porous material 150. As shown, the body of porous material 150 may be attached to an inside surface of the applicator tip 160. Alternatively, the body of porous material 150 may be attached to an inside surface of the applicator body 120. In the embodiment shown, the applicator tip 160 can be attached on the inside of the applicator body 120. The applicator tip 160 has an orifice or opening 170 for dispensing adhesive material from the applicator device 110.

According to this embodiment, the applicator body 120 is flexible to allow the applicator body 120 to be squeezed to break or rupture the frangible vial 140. In particular, the applicator body 120 may include a breaking means to facilitate breaking the frangible vial 140. For example, the applicator body may include a ridge 125 on an inside surface thereof as the breaking means, as shown in FIG. 10.

The body of porous material 150 may contain a polymerization and/or cross-linking initiator for the polymerizable and/or cross-linkable material 130. In such case, the applicator tip 160 may be designed to allow mixing of the polymerization and/or cross-linking initiator and the polymerizable and/or cross-linkable material 130 prior to application. After the polymerizable and/or cross-linkable material 130 flows through the body of porous material 150, the narrowing of the applicator tip 160 to the orifice 170 forces the polymerization and/or cross-linking initiator and the polymerizable and/or cross-linkable material 130 to mix substantially before exiting through the orifice 170. Various design modifications may be made to the body of porous material 150 to provide a desired performance. For example, the pore size and or the length of the body of porous material 150 may be changed as desired.

Figure 11:
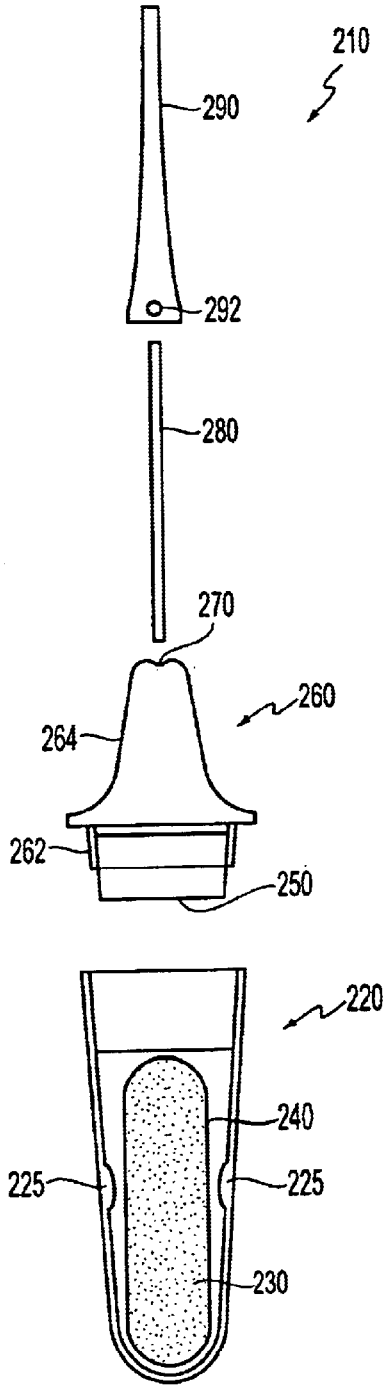
FIG. 11 is an exploded elevational view of another embodiment of the applicator devices according to the present invention.

FIG. 11 shows an exploded view of yet another embodiment of an applicator device 210 according to the present invention. The applicator device 210 comprises an applicator container or body 220 holding a polymerizable and/or cross-linkable adhesive material 230, such as enclosed in a frangible vial 240. One end of the applicator device 210 is sealed, and the other end of the applicator device 210 is open to receive an applicator tip 260 that includes a body of porous material 250. As shown, the body of porous material 250 may be attached to an inside surface of the applicator tip 260. As shown in FIG. 11, the applicator tip 260 can be attached on the inside of the applicator body 220. The applicator tip 260 has an orifice or opening 270 for dispensing adhesive material from the applicator device 210.

According to the embodiment shown in FIG. 11, the applicator body 220 is flexible to allow the applicator body 220 to be squeezed to break or rupture the frangible vial 240. In particular, the applicator body 220 may include a breaking means to facilitate breaking the frangible vial 240. For example, the applicator body may include a ridge 225 on an inside surface thereof as the breaking means, as shown in FIG. 11. Further, the frangible vial 240 may be pre-scored, for example, using a glass cutter, or dimpled, for example, by heating a section while pulling, to provide controlled breaking, especially adjacent the ridge 225.

As shown in FIG. 11, the applicator device 210 also includes a flow control member 280 that can be attached to the applicator tip 260. Various designs of the flow control member 280 are contemplated by the present invention. For example, in the embodiment shown, the flow control member 280 comprises a cannula. Such a cannula facilitates accurate placement of the adhesive in spaces where the applicator tip 260 cannot provide adequate access and provides precise control of the amount of adhesive dispensed. Also, the flow control member 280 may comprise a tortuous flow path or may have rough inner walls to provide extra or additional mixing, as described below.

The body of porous material 250 may contain a polymerization and/or cross-linking initiator for the polymerizable and/or cross-linkable material 230. In such case, the applicator tip 260 may be designed to allow mixing of the polymerization and/or cross-linking initiator and the polymerizable and/or cross-linkable material 230 prior to application. After the polymerizable and/or cross-linkable material 230 flows through the body of porous material 250, the narrowing of the applicator tip 260 to the orifice 270 forces the polymerization and/or cross-linking initiator and the polymerizable and/or cross-linkable material 230 to mix substantially before exiting through the orifice 270.

As shown in FIG. 11, the applicator device 210 also includes a secondary container 290 that is arranged to cooperate with the applicator tip 260, for example, by fitting over an end portion of the applicator tip 260 including the orifice 270. The secondary container 290 provides an alternative manner in which the adhesive may be applied. The polymerizable and/or cross-linkable material 230 may be expressed from the applicator body 220, through orifice 270 of the applicator tip 260, and into the secondary container 290. The secondary container 290 then serves as a reservoir for application of the expressed polymerizable and/or cross-linkable material 230.

Further, when the body of porous material 250 contains a polymerization and/or cross-linking initiator, the secondary container 290 may be used to provide additional mixing so that homogeneous properties of the mixture of the polymerizable and/or cross-linkable material 230 are obtained. As described below, the secondary container 290 allows the polymerizable and/or cross-linkable material 230 to pass through the body of porous material 250 multiple times and provides a reservoir that allows the flow of the polymerizable and/or cross-linkable material 230 to mix the polymerizable and/or cross-linkable material 230 and the polymerization and/or cross-linking initiator.

The additional mixing provided by the secondary container 290 may be needed for certain materials and/or initiators. For example, absorbable cyanoacrylates and/or less reactive cyanoacrylates may require better mixing to obtain a desired level of homogeneity of properties. In addition to the additional mixing in the secondary container 290, the applicator device 210 may be manipulated to pass the polymerizable and/or cross-linkable material 230 through the body of porous material 250 multiple times. For example, the polymerization and/or cross-linking initiator and the polymerizable and/or cross-linkable material 230 may be expressed into the secondary container 290, sucked back into the applicator body 220 and re-expressed as needed for proper mixing. The expressed mixture may acquire more of the polymerization and/or cross-linking initiator with each pass. The number of passes may be changed based on the particular application.

The flow control member 280 may be designed to facilitate the multiple mixing passes, such as the cannula shown which extends near the closed end of the secondary container 290. Also, the secondary container 290 may include a hole or opening 292 near an end that cooperates with the applicator tip 260 to allow airflow and avoid airlock.

Figure 12:
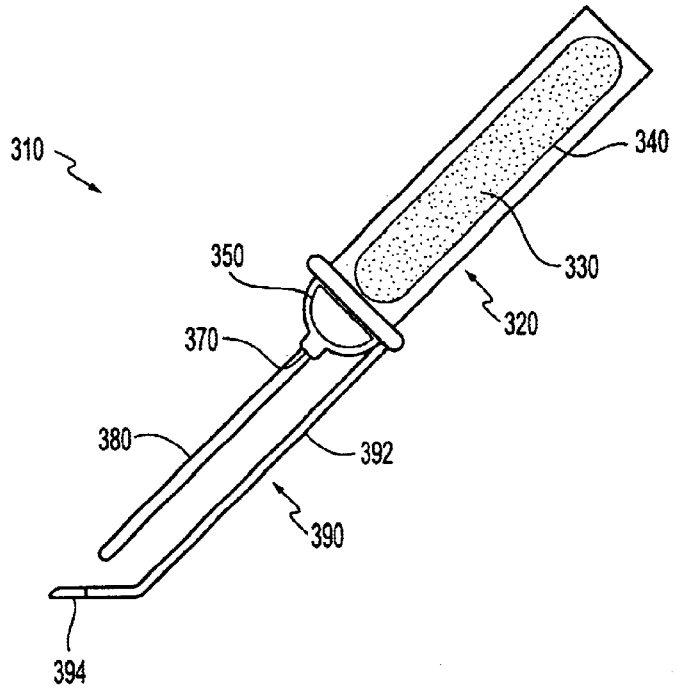
FIG. 12 is a side view of another embodiment of the applicator devices according to the present invention.

FIG. 12 shows a side view of another embodiment of an applicator device 310 according to the present invention. The applicator device 310 comprises an applicator container or body 320 holding a polymerizable and/or cross-linkable adhesive material 330, such as enclosed in a frangible vial 340. One end of the applicator device 310 is sealed, and the other end of the applicator device 310 receives a body of porous material 350. As shown, the body of porous material 350 may be attached to an inside surface of the applicator body 320. The end of the applicator body 320 that includes the body of porous material 350 may be removable or fixed and has an orifice or opening 370 for dispensing adhesive material from the applicator device 310.

According to this embodiment, the applicator body 320 is flexible to allow the applicator body 320 to be squeezed to break or rupture the frangible vial 340. In particular, the applicator body 320 may include a breaking means (not shown) to facilitate breaking the frangible vial 340.

The body of porous material 350 may contain a polymerization and/or cross-linking initiator for the polymerizable and/or cross-linkable material 330. The polymerization and/or cross-linking initiator in the body of porous material 350 will activate the polymerizable and/or cross-linkable material 330 prior to application as the polymerizable and/or cross-linkable material 330 passes through and/or contacts the body of porous material 350 before exiting the through the orifice 370.

As shown in FIG. 12, the applicator device 310 also includes a flow control member 380 that can be attached to or inserted into the orifice 370. Various designs of the flow control member 380 are contemplated by the present invention. For example, in the embodiment shown, the flow control member 380 comprises a cannula. Such a cannula facilitates accurate placement of the adhesive.

As shown in FIG. 12, the applicator device 310 also includes an applicator head 390 comprising an arm 392 that extends from the applicator body 320 and terminates with an applicator tip 394. The flow control member 380 and the applicator head are arranged so that the polymerizable and/or cross-linkable material 330 is expressed onto the applicator tip 260 for application to a desired site. The polymerizable and/or cross-linkable material 330 may be fed dropwise onto the applicator tip using the flow control member 380.

Figure 13:
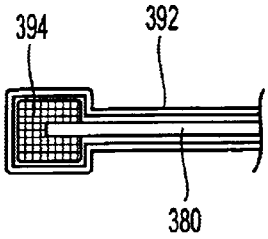
FIGS. 13, 14 and 15 are partial top views showing various applicator tips according to the present invention for the embodiment of FIG. 12.

Various designs of the applicator tip 394 are contemplated by the present invention. For example, in the embodiment shown in FIGS. 12 and 13, the applicator tip 394 comprises a mesh of a material suitable for applying the polymerizable and/or cross-linkable material 330.

Figure 14:
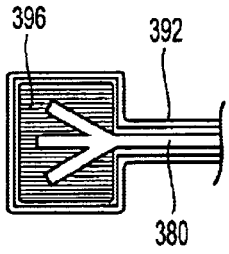

In the embodiment shown in FIG. 14, the applicator tip comprising a grid 396. With the grid 396, the flow control member 380 may be provided with multiple outlets to evenly supply the grid 396 with the polymerizable and/or cross-linkable material 330.

Figure 15:
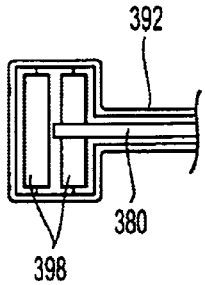

In the embodiment shown in FIG. 15, the applicator tip comprises one or more rollers 398. Each of these exemplary applicator tips 394, 396, 398 may be used for applications to relatively large areas.

It is to be understood that any suitable combination of the features of the various embodiments disclosed herein may be incorporated into an applicator device according to the present invention. As such, while every possible combination is not illustrated in the exemplary embodiments shown, such combinations are fully contemplated by the present invention.

According to the present invention, the applicator can include any suitable adhesive material. The adhesive material can include monomeric (including pre-polymeric) materials, polymeric materials, or mixtures thereof. The monomer (including prepolymeric) adhesive composition may include one or more polymerizable monomers. Preferred adhesive compositions for use in applicators of the present invention are useful as tissue adhesives, sealants for preventing bleeding or for covering open wounds, and in other biomedical applications. They find uses in, for example, apposing surgically incised or traumatically lacerated tissues; retarding blood flow from wounds; dressing burns; dressing skin or other superficial or surface wounds such as compromised skin or other tissue (such as abrasions, chaffed or raw skin, minor cuts and scrapes, sores and/or ulcers such as stomatitis); protecting intact skin; and aiding repair and regrowth of living tissue. Adhesive compositions of the present invention are also useful in industrial and home applications, for example in bonding rubbers, plastics, wood, composites, fabrics, and other natural and synthetic materials.

Preferred monomers that may be used in this invention are readily polymerizable, e.g. anionically polymerizable or free radical polymerizable, or polymerizable by zwitterions or ion pairs to form polymers. Such monomers include those that form polymers, that may, but do not need to, biodegrade. Such monomers are disclosed in, for example, U.S. Pat. No. 5,328,687 to Leung, et al., which is hereby incorporated in its entirety by reference herein.

Particularly preferred adhesive materials are 1,1-disubstituted ethylene monomers including, but not limited to, monomers of the formula:

$$\text{(I)}\quad HRC{=}CXY$$

wherein X and Y are each strong electron withdrawing groups, and R is H, $—CH{=}CH_2$ or, provided that X and Y are both cyano groups, a $C_1$–$C_4$ alkyl group. Examples of monomers within the scope of formula (I) include α-cyanoacrylates, such as ethyl, butyl and/or 2-octyl cyanoacrylate, vinylidene cyanides, $C_1$–$C_4$ alkyl homologues of vinylidene cyanides, dialkyl methylene malonates, acylacrylonitriles, vinyl sulfonates and vinyl sulfonates of the formula $CH_2{=}CX'Y'$ wherein X' is $—SO_2R'$ or $—SO_3R'$ and Y' is —CN, —COOR', $—COCH_3$, $—SO_2R'$ or $—SO_3R'$, and R' is H or hydrocarbyl.

Furthermore, the adhesive composition contained in the applicator can further include various additives as are known in the art, including but not limited to flavorants, preservatives, plasticizing agents, stabilizing agents, formaldehyde concentration reducing agents, pH modifiers, thickening agents, cross-linking agents, fibrous reinforcement agents, colorants, and the like.

Suitable compositions, methods of making such compositions, and methods for incorporating such compositions into a dispenser device are described, for example, in U.S. Pat. No. 5,928,611 to Leung; U.S. Pat. Nos. 5,328,687, 5,514,371, 5,514,372, 5,575,997, 5,582,834 and 5,624,669, all to Leung et al; U.S. Pat. No. 5,259,835 to Clark et al.; U.S. Pat. No. 3,527,841 to Wicker et al.; U.S. Pat. No. 3,722,599 to Robertson et al.; U.S. Pat. No. 3,995,641 to Kronenthal et al.; and U.S. Pat. No. 3,940,362 to Overhults; and U.S. patent application Ser. Nos. 08/266,647, 08/714,288, 09/099,457, 09/430,177, and (100497.02 filed Oct. 29, 1999), the entire disclosures of which are incorporated herein by reference.

According to the present invention, the porous shaped body, whether integral with or used in combination with the applicator tip, may, but need not, include a polymerization and/or cross-linking initiator and/or rate modifier, such as an accelerator or inhibitor, for a polymerizable monomer adhesive material contained in the applicator. Suitable polymerization and/or cross-linking initiators and rate modifiers, and methods for applying them to the applicator tip, are described in, for example, U.S. Pat. No. 5,928,611 and U.S. patent application Ser. No. 09/430,177, filed Oct. 29, 1999, Ser. Nos. 09/430,176, 09/430,289, 09/430,290, and 09/430,180 filed Oct. 29, 1999; 09/343,914 filed Jun. 30, 1999; 09/385,030 filed Aug. 30, 1999; and 09/176,889 filed Oct. 22, 1998, the entire disclosures of which are incorporated herein by reference. Preferred initiators for some medical uses include benzalkonium chloride, and for some industrial uses include dimethyl toluidine.

The polymerization and/or cross-linking initiator and/or rate modifier may be applied to the porous shaped body by any suitable means, including, but not limited to, spraying, dipping, injecting, or brushing the porous shaped body with a liquid medium containing the polymerization and/or cross-linking material. It is preferably applied by dipping or injecting. For example, it may be applied by pumping of the liquid medium, for example, through a syringe, onto the distal end of the porous shaped body.

The polymerization and/or cross-linking initiator and/or rate modifier may be applied to the porous shaped body by using a vacuum or pressure process. In each process, a solution or suspension of the polymerization and/or cross-linking initiator and/or rate modifier is introduced into a vacuum or pressure chamber. One or more porous shaped bodies, either individually or preferably in batches, are placed into the solution or suspension in the pressure vessel in a manner such that they preferably do not float to the top of the solution or suspension. For example, they can be placed in the solution or suspension in a wire basket or other suitable container, which would hold them under the solution or suspension, or a wire mesh or other suitable retainer could be placed over them to dunk or sink them into the solution or suspension. Once they are in the solution or suspension, the vessel can be sealed and an appropriate vacuum or pressure applied.

Application of the vacuum or pressure results in air that is trapped in the porous shaped bodies being degassed, or forced out of the porous shaped bodies, and being replaced by the solution or suspension. This replacement of air by the solution or suspension thereby loads the material onto or into the porous shaped bodies. The end of the degassing phase can be observed by the absence of newly formed air bubbles. After a desired treatment time, the vacuum or pressure in the vessel can be released, and the treated porous shaped bodies can be removed.

In exemplary embodiments, preparing an applicator for dispensing polymerizable monomeric compositions includes applying a material to a suitable porous shaped body, such as a porous polyethylene, foam or fibrous tip, which is attached to an applicator body, such as a butyrate applicator tube or other suitable holder.

In addition to the polymerization and/or cross-linking initiator and/or rate modifier, the porous shaped body and/or applicator tip can also include various other materials that may or may not act as a polymerization initiator and/or rate modifier. For example, they can include a flavorant, such that it imparts a flavor to the adhesive material when the adhesive material is applied to a surface. Incorporation of a flavorant is particularly preferred, for example, when the cyanoacrylate adhesive material is to be applied to oral surfaces, such as to treat ulcers such as stomatitis or cold sores. Similarly, they can include a bioactive material, which may or may not also be a polymerization and/or cross-linking initiator and/or rate modifier. Examples of suitable bioactive materials include, but are not limited to, medicaments such as antibiotics, antimicrobials, antiseptics, bacteriocins, bacteriostats, disinfectants, steroids, anesthetics, antifungal agents, anti-inflammatory agents, antibacterial agents, antiviral agents, antitumor agents, growth promoting substances, antioxidants, or mixtures thereof.

The porous shaped body may be composed of any of a variety of materials including polymerized materials such as plastics, foams, rubber, thermoset resins, films, fibers, or membranes. Where foams are used, the foam can be either an open-celled form, a closed-cell foam, or a mixture thereof. Any suitable foam material can be used and suitable foams include, for example, thermoplastic polyurethane foam, preferably a soft, absorbent thermoplastic polyurethane foam.

In embodiments, the porous shaped body may be made from polyurethane, polyesters, polyolefins such as polyethylene, or polyamides. In embodiments, it may be made from polyethylene, such as that sold by Porex Technologies Corp. (Fairburn, Ga.) under the trademark Lab-Por®. In embodiments, the porous shaped body can also be made from fibers, either natural or synthetic, such as cotton, rayons, nylons, and mixtures thereof. Additionally, the porous shaped body may be composed of materials such as metal, glass, paper, ceramics, and the like. It may be absorbent or adsorbent in nature to enhance and facilitate loading of a material on or in the applicator tip. For example, the porous shaped body may be composed of a material having random pores, capillaries, a honeycomb material, a material having a woven pattern, etc. The degree of porosity will depend on the materials being used, and can be determined by one of ordinary skill in the art without undue experimentation. Porosity is the open volume within the pores of a porous shaped body divided by the total volume of the porous shaped body.

In embodiments, the porous shaped body may have an average pore size of about 1 $\mu$m to about 500 $\mu$m. Generally, according to the present invention, an average pore size of about 1–100 $\mu$m such as 10–30 is used with a polymerizable material having a viscosity of about 1–30 cP, preferably about 2–18 cP, and more preferably 5–7 cP at 25° C. An average pore size of from about 1 $\mu$m to about 100 $\mu$m is preferably used with a polymerizable material having a viscosity of about 10–30 cP. When the polymerizable and/or cross-linkable material has a viscosity higher than 7 cP, the average pore size is generally increased. For example, an average pore size of about 40–300 μm such as 60–125 μm is preferably used with a polymerizable material having a viscosity of about 30–500 cP, preferably about 35–350 cP, and more preferably about 50–200 or 60–140 cP at 25° C. In embodiments, the pore volume is less than or equal to 80 percent, preferably between 20–60 percent.

In embodiments of the present invention, the adhesive composition has a viscosity of about 1–5000 centipoise, preferably 1–600 centipoise, more preferably 1–100 or 2–50 centipoise such as 2–18, 2–10 or 5–7 centipoise, or 30–500 such as 50–100 or 100–200 centipoise at 25° C. The viscosity can be selected according to the proposed use—e.g., 1–100 centipoise for certain uses and 100–200 centipoise for other uses. Additionally, the composition may be a gel, e.g., 50,000–500,000 centipoise at 25° C. The viscosity of the adhesive composition can be measured with a Brookfield Viscometer. Additionally, in embodiments where a sterilization treatment is applied, the viscosity of the composition should preferably be maintained or increased by a controlled and acceptable amount after sterilization.

When the applicator tip and/or applicator includes a shaped body of porous material, the composition preferably is not expressed directly through the shaped body in a continuous motion. According to embodiments of the present invention, the adhesive composition is (1) expressed to the end or part way to the end of the porous material, (2) the pressure is released to draw the composition back into the applicator, and (3) the composition is then subsequently expressed through the applicator tip in a continuous motion. This is called a suck-back method of applying the adhesive composition of the present invention. When used with a porous material that bears an initiator, this method lets the adhesive composition polymerize better than if it had been expressed directly through the tip.

Once the applicator assembly is prepared, the assembly (or individual components thereof) can be sterilized according to known practices. Compatibility of the adhesive composition, the applicator, the applicator tip, the porous shaped body, and the packaging, with one or more sterilization procedures is preferred in embodiments of the present invention because many uses of the adhesive compositions, such as many surgical and other medical applications, require sterilized products. In preferred embodiments, there is substantially no initiation of polymerization of monomeric liquid adhesive compositions that affects the utility of the monomer or monomers caused by the sterilization process, even when repeated sterilization steps are applied.

Sterilization of the monomer composition and/or its packaging can be accomplished by techniques known to the skilled artisan, and is preferably accomplished by methods including, but not limited to, chemical, physical, and/or irradiation methods. Examples of chemical methods include, but are not limited to, exposure to ethylene oxide or hydrogen peroxide vapor. Examples of physical methods include, but are not limited to, sterilization by heat (dry or moist) or retort canning. Examples of irradiation methods include, but are not limited to, gamma irradiation, electron beam irradiation, and microwave irradiation. A preferred method is electron beam irradiation. In embodiments where a composition is to be used for medical applications, the sterilized composition must show low levels of toxicity to living tissue during its useful life.

While the invention has been described with reference to preferred embodiments, the invention is not limited to the specific examples given, and other embodiments and modifications can be made by those skilled in the art without departing from the spirit and scope of the invention.

What is claimed is:

1. An applicator for dispensing adhesive material, comprising:

a container body containing an adhesive material, wherein said adhesive material is a synthetic or semi-synthetic polymerizable or cross-linkable monomer material;

a body of porous material, wherein said adhesive material is located in said container body in a non-contacting relationship with said porous material prior to dispensing said adhesive material;

an applicator tip having an open end open toward said container body and at least one orifice, wherein at least a portion of said porous material is located in said open end of said applicator tip and wherein said applicator tip permits said adhesive material to pass through said porous material and exit said applicator tip at said at least one orifice; and a removable secondary container that cooperates with said applicator tip to receive said adhesive material that exits said applicator tip.

2. The applicator according to claim 1, wherein said applicator tip is attached to an inside surface of said container body.

3. The applicator according to claim 2, wherein said applicator tip is attached to said container body by at least one of an adhesive material, chemical bonding, and ultrasonic welding.

4. The applicator according to claim 2, wherein said applicator tip is attached to said container body by heat-shrinking a portion of said container body onto said applicator tip body.

5. The applicator according to claim 2, wherein said applicator tip is attached to said container body by one of pressure, friction fitting, threads, and luer locks.

6. The applicator according to claim 1, wherein said porous material is attached to an inside surface of said container body.

7. The applicator according to claim 1, wherein said porous material is attached to an inside surface of said applicator tip.

8. The applicator according to claim 1, wherein said applicator tip comprises a first portion that is attached to said container body, and a second portion that extends away from said container body and comprises said at least one orifice.

9. The applicator according to claim 8, wherein said second portion forms a conduit from said container body to said orifice, through which the adhesive material travels.

10. The applicator according to claim 8, wherein said second portion has a tapered profile from said first portion to said orifice.

11. The applicator according to claim 8, wherein said second portion has a longitudinal axis that is substantially parallel to a longitudinal axis of said applicator.

12. The applicator according to claim 8, wherein said second portion has a longitudinal axis that is not substantially parallel to a longitudinal axis of said applicator.

13. The applicator according to claim 1, wherein at least one of said container body and said applicator tip has at least one male mating feature and the other of said container body and said applicator tip has at least one complementary female mating feature for attaching said applicator tip to said container body.

14. The applicator according to claim 1, further comprising a removable cap that closes an open end of said container body which receives said applicator tip.

15. The applicator according to claim 1, further comprising a flow control member that extends from said applicator tip.

16. The applicator according to claim 15, wherein the flow control member is inserted into said orifice of said applicator tip.

17. The applicator according to claim 15, wherein the flow control member comprises a tortuous flow path.

18. The applicator according to claim 15, wherein the flow control member comprises a cannula.

19. The applicator according to claim 18, wherein the cannula comprises a tortuous flow path.

20. The applicator according to claim 18, wherein at least a portion of an inner surface of the cannula is rough.

21. The applicator according to claim 1, wherein said removable secondary container is arranged to receive said adhesive material that exits said applicator tip so as to permit said adhesive material that exits said applicator tip to flow from said removable secondary container into said applicator tip.

22. The applicator according to claim 21, wherein said container body is flexible so as to be manipulated to cause said adhesive material to exit said applicator tip and to flow from said removable secondary container into said applicator tip.

23. The applicator according to claim 21, wherein said container body is flexible so as to be manipulated to cause said adhesive material to exit said applicator tip and to flow from said removable secondary container into said container body.

24. The applicator according to claim 1, wherein said container body is flexible.

25. The applicator according to claim 24, wherein said adhesive material is contained by a barrier that is broken or pierced by squeezing said flexible container body.

26. The applicator according to claim 25, wherein said barrier comprises a frangible vial.

27. The applicator according to claim 26, wherein said frangible vial is pre-scored.

28. The applicator according to claim 26, wherein said frangible vial is dimpled.

29. The applicator according to claim 1, wherein said porous material has a polymerization or cross-linking initiator or rate modifier for said adhesive material disposed thereon or therein.

30. The applicator according to claim 1, wherein said adhesive material comprises 1,1-disubstituted ethylene monomers.

31. The applicator according to claim 1, wherein said adhesive material comprises α-cyanoacrylate monomers.

32. The applicator according to claim 1, further comprising:

at least one breaking means located on at least one of said porous material, said applicator tip and said container body for breaking a container of said adhesive material contained in said container body.

33. The applicator according to claim 32, wherein said breaking means is a spike.

34. The applicator according to claim 33, wherein said spike is hollow to permit adhesive to flow through said spike.

35. The applicator according to claim 32, wherein said breaking means extends from one of said porous material and said applicator tip into said container body.

36. The applicator according to claim 32, wherein said breaking means is partially embedded in said porous material.

37. The applicator according to claim 32, wherein said breaking means is fully embedded in said porous material.

38. The applicator according to claim 32, wherein said breaking means is disposed on an inner surface of said container body.

39. The applicator according to claim 32, wherein said breaking means comprises a ridge.

40. The applicator according to claim 32, wherein said container of said adhesive material contained in said container body comprises a frangible vial.

41. The applicator according to claim 40, wherein said frangible vial is pre-scored.

42. The applicator according to claim 40, wherein said frangible vial is dimpled.

43. A kit for dispensing adhesive material, comprising at least one saleable package containing:

at least one applicator according to claim 1.

44. The kit according to claim 43, wherein said kit contains at least two of said applicator tips that are attachable to said at least one applicator and have different configurations.

45. The kit according to claim 43, wherein said kit contains more applicator tips than applicators.

46. The kit according to claim 43, further comprising a removable cap that closes an open end of said container body which receives said at least one applicator tip.

47. The kit according to claim 43, wherein each applicator and each applicator tip is individually packaged in a separate blister pack.

48. The kit according to claim 43, wherein at least one applicator and at least one applicator tip are packaged together in a single blister pack.

49. The kit according to claim 43, wherein at least one applicator and at least two applicator tips are packaged together in a single blister pack.

50. The kit according to claim 43, further comprising at least one flow control member that is attachable to said at least one applicator tip.

51. The kit according to claim 50, wherein said kit contains at least two flow control members that are attachable to said at least one applicator tip and have different configurations.

52. The kit according to claim 50, wherein said kit contains more flow control members than applicator tips.

53. The kit according to claim 43, wherein said at least one applicator tip is attachable to an inside surface of said at least one applicator.

54. The kit according to claim 53, wherein said at least one applicator tip is attachable to said at least one applicator by one of pressure, friction fitting, threads, and luer locks.

55. The kit according to claim 43, wherein said adhesive material is a synthetic or semi-synthetic polymerizable or cross-linkable monomer material.

56. The kit according to claim 43, wherein said adhesive material comprising 1,1-disubstituted ethylene monomers.

57. The kit according to claim 43, wherein said adhesive material comprises α-cyanoacrylate monomers.

58. The kit according to claim 43, wherein said at least one applicator tip includes a porous body that has a polymerization or cross-linking initiator or rate modifier for said adhesive material disposed thereon or therein.

59. An applicator for dispensing adhesive material, comprising:

a container body containing an adhesive material, wherein said adhesive material is a synthetic or semi-synthetic polymerizable or cross-linkable monomer material;

a body of porous material, wherein said adhesive material is located in said container body in a non-contacting relationship with said porous material prior to dispensing said adhesive material, said porous material located adjacent an end of said container body having at least one orifice such that said adhesive material passes through said porous material to exit at said at least one orifice; and an applicator head comprising an arm extending from said container body and terminating with an applicator tip.

60. The applicator according to claim 59, further comprising a flow control member in communication with said at least one orifice and arranged to deliver said adhesive dropwise to said applicator tip.

61. The applicator according to claim 59, wherein the flow control member comprises one of a mesh, a grid and at least one roller.

* * * * *